US010422106B2

(12) United States Patent
Indovina

(10) Patent No.: US 10,422,106 B2
(45) Date of Patent: Sep. 24, 2019

(54) REMOVABLE WIPER WALL

(71) Applicant: Deere & Company, Moline, IL (US)

(72) Inventor: Chad M. Indovina, Thibodaux, LA (US)

(73) Assignee: DEERE & COMPANY, Moline, IL (US)

( * ) Notice: Subject to any disclaimer, the term of this patent is extended or adjusted under 35 U.S.C. 154(b) by 155 days.

(21) Appl. No.: 15/638,688

(22) Filed: Jun. 30, 2017

(65) Prior Publication Data

US 2019/0003149 A1 Jan. 3, 2019

(51) Int. Cl.
*E02F 3/64* (2006.01)
*E02F 3/65* (2006.01)

(52) U.S. Cl.
CPC ..... *E02F 3/6454* (2013.01); *E02F 3/656* (2013.01); *E02F 3/6427* (2013.01)

(58) Field of Classification Search
CPC ..... E02F 3/64; E02F 3/6427; E02F 3/6472; E02F 3/65; E02F 3/654
USPC ..... 172/781, 799.5
See application file for complete search history.

(56) References Cited

U.S. PATENT DOCUMENTS 2,136,102 A * 11/1938 Heil ..... E02F 3/6472 37/424
2,212,713 A * 8/1940 Le Bleu ..... E02F 3/6472 37/424
2,255,240 A * 9/1941 Bird ..... E02F 3/6472 37/412
3,651,589 A * 3/1972 Reynolds ..... E02F 3/64 37/414
4,073,077 A * 2/1978 Essel ..... E01H 5/065 172/777
4,398,363 A * 8/1983 Miskin ..... E02F 3/64 37/429
4,707,936 A * 11/1987 Steinhoff ..... E01H 5/065 37/264
6,612,050 B2 * 9/2003 Takeuchi ..... E01H 5/061 37/232
8,813,864 B2 * 8/2014 Layton ..... E02F 3/84 172/311

* cited by examiner

*Primary Examiner* — Gary S Hartmann
(74) *Attorney, Agent, or Firm* — Taft Stettinius & Hollister LLP; Stephen F. Rost

(57) ABSTRACT

A scraper having a frame with a first removable sidewall removably coupled to the frame, a second removable sidewall removably coupled to the frame, a rear bucket pivotally coupled to the frame and having a dump position and a carry position, the rear bucket comprising a first rear sidewall positioned on a first side of the rear bucket and a second rear sidewall positioned on a second side of the rear bucket. Wherein, the first removable sidewall is positioned adjacent to the first rear sidewall and the second removable sidewall is positioned adjacent to the second rear sidewall. Further wherein, as the rear bucket transitions between the carry position and the dump position, the first and second removable sidewalls move relative to the surface of the corresponding first and second rear sidewalls.

18 Claims, 10 Drawing Sheets

REMOVABLE WIPER WALL

FIELD OF THE DISCLOSURE

The present disclosure relates to a scraper assembly, and in particular, to a system and method for assembling a wiper wall on the scraper assembly.

BACKGROUND OF THE DISCLOSURE

Carry-all scrapers and the like are pulled by a tractor or other mover and used to capture and redistribute portions of an underlying surface. Scrapers typically are coupled to the tractor through a hitch and are hydraulically controlled to transition between a scraping configuration, a transport configuration, and a dump configuration. In the scraping configuration, a blade digs into the underlying surface as the scraper is pulled therealong. As the blade digs into the underlying surface, a portion of the underlying surface is disrupted by the blade and deposited into a bucket of the scraper as debris. Once the bucket is full of debris, the blade is raised and no longer contacts the underlying surface during transport. Typically, the full bucket is transported to a dump site where the scraper articulates to the dump configuration and the debris within the bucket is deposited onto the underlying surface.

The typical scraper utilizes overlapping side walls between the bucket and the frame to contain debris therein and facilitate the complete removal of debris during the dump configuration. As the scraper transitions to and from the dump configuration, the overlapping side walls come into close proximity to one another, sometimes contacting one another. Further, debris may become positioned between the overlapping sidewalls.

SUMMARY

One embodiment includes a scraper having a frame with a first removable sidewall removably coupled to the frame and a second removable sidewall removably coupled to the frame. A rear bucket may be pivotally coupled to the frame and have a dump position and a carry position, the rear bucket including a first rear sidewall positioned on a first side of the rear bucket and a second rear sidewall positioned on a second side of the rear bucket. Wherein, the first removable sidewall is positioned adjacent to the first rear sidewall and the second removable sidewall is positioned adjacent to the second rear sidewall. Further wherein, as the rear bucket transitions between the carry position and the dump position, the first and second removable sidewalls move relative to the surface of the corresponding first and second rear sidewalls.

One example of this embodiment includes a first and second bracket coupled to the frame, wherein the first and second removable sidewalls are removably coupled to the corresponding first and second bracket. Further, the first removable sidewall is coupled to the first bracket at a first bracket face, wherein the first bracket face is not planar. Further, the second removable sidewall is coupled to the second bracket at a second bracket face, wherein the second bracket face is not planar.

In another example, there may be one or more removable fastener coupling the first and second removable sidewall to the frame. Wherein the one or more removable fastener couples the first removable sidewall to the frame in a non-planar orientation and the one or more removable fastener couples the second removable sidewall to the frame in a non-planar orientation.

In yet another example, the first and second removable sidewalls each have a scraping end and a coupling end, the coupling end having an L-shaped profile.

In another example of this embodiment, a portion of the respective first and second removable sidewalls is drawn towards the respective first and second rear sidewalls when the first and second removable sidewalls are coupled to the frame.

Another embodiment includes a method of manufacturing a scraper, including providing a frame assembly, a bucket assembly having at least one sidewall, at least one removable sidewall, and fasteners, pivotally coupling the frame assembly to the bucket assembly, and removably coupling the removable sidewall to the frame with one or more fastener.

In one example, the fasteners are countersunk into the removable sidewall.

In another example, the removably coupling the removable sidewall to the frame with one or more fasteners step includes deforming an outer surface of the removable sidewall out of planar alignment when coupling at least one of the fasteners.

Another example includes providing a bracket and coupling the bracket to the frame, wherein the removable sidewall is coupled to the frame through the bracket. In this example, the bracket is positioned to avoid interference with the at least one sidewall of the bucket assembly when the scraper is in both a dump configuration and a carry configuration.

In another example, the removably coupling the removable sidewall to the frame with one or more fastener step includes deforming the removable sidewall towards the sidewall of the bucket assembly. In this example, a portion of the removable sidewall contacts the sidewall of the bucket assembly.

A different embodiment may be a scraper system having a frame assembly having a frame arm, a bucket assembly having a first sidewall, and a second sidewall removably coupled to the frame arm. Wherein, the bucket assembly is pivotally coupled to the frame arm and the second sidewall is positioned adjacent to the first sidewall.

In one example of this embodiment, the second sidewall is coupled to the frame arm with threaded fasteners.

In another example of this embodiment, the second sidewall is removable from the frame arm without using a cutting tool.

In yet another example, a bracket may be coupled to the frame arm, wherein the second sidewall is coupled to the frame arm via the bracket. Further, the bracket defines a coupling surface that is not planar. Further still, the second sidewall is coupled to the corresponding bracket along the coupling surface.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
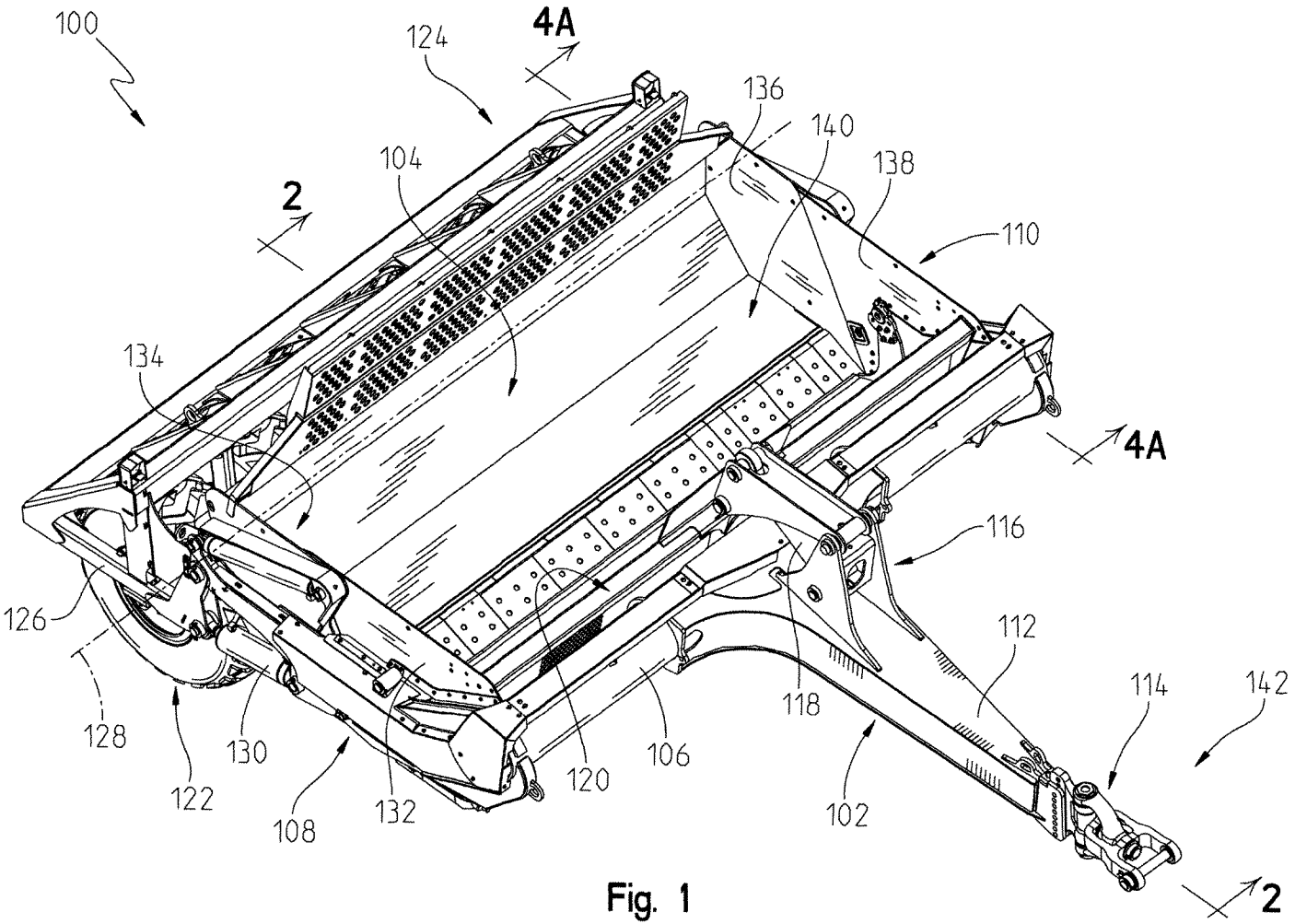
FIG. 1 is an elevated perspective view of a scraper assembly.
Figure 8:
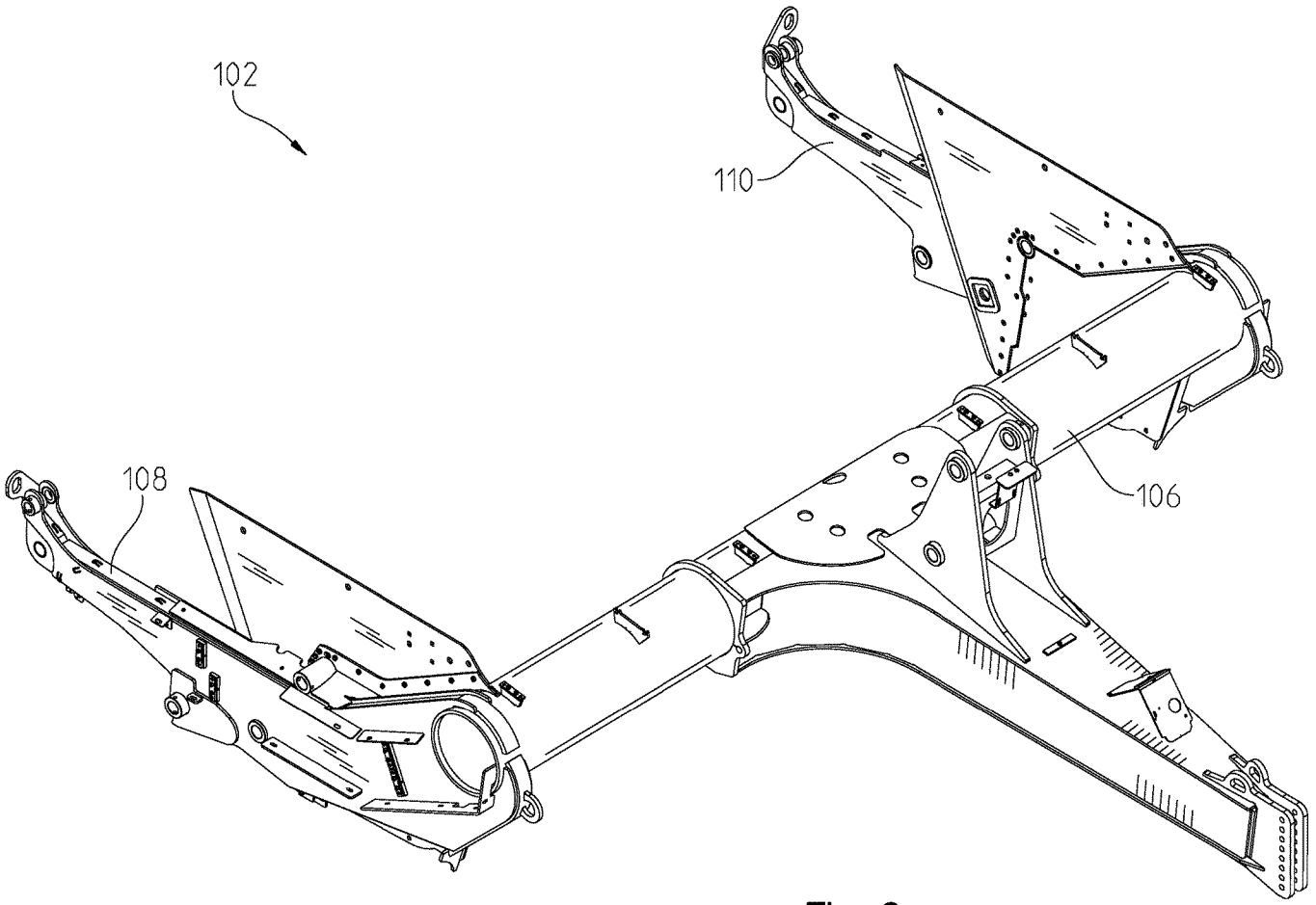
FIG. 8 is an isolated perspective view of a frame assembly for the scraper assembly of FIG. 1.
Figure 9:
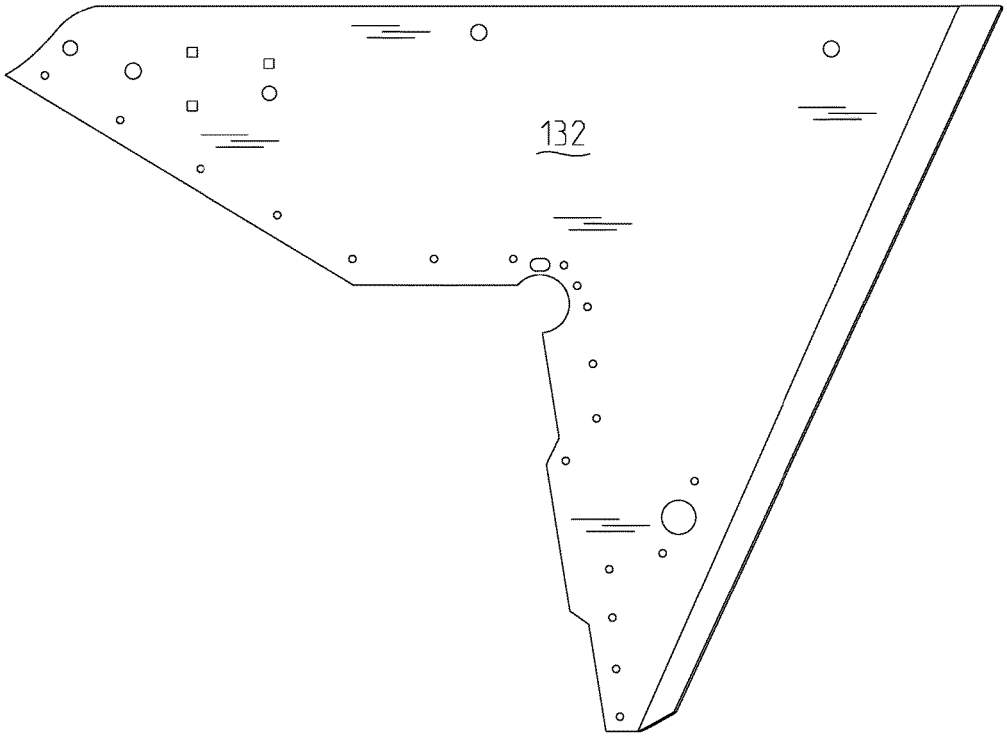
FIG. 9 is an isolated view of the removable sidewall of the scraper assembly of FIG. 1.

Referring to FIG. 1, an isolated view of a carry-all scraper assembly 100 is illustrated. The scraper 100 may have a frame assembly 102 (see also FIG. 8) pivotally coupled to a bucket assembly 104. The frame assembly 102 may have a cross member 106 coupled to a first frame arm 110 on one end and coupled to a second frame arm 108 on the other end. Further, a neck 112 may extend from a portion of the cross member 106. The neck 112 may be configured to provide a hitching mechanism 114 on one end that allows the scraper assembly 100 to be removably coupled to a tractor or other pulling machine.

While the embodiment of FIG. 1 is shown and described isolated from a tractor or pulling machine, this disclosure applies equally to scrapers that are integrated into a tractor or pulling machine. In other words, this disclosure applies equally to scrapers that are removable from a tractor and to scrapers that are integrally formed as part of a machine.

Among other things, the frame assembly 102 can accommodate a gate lift assembly 116. The gate lift assembly 116 may have a gate actuator 118 pivotally coupled thereto and configured to reposition a gate 120. The gate lift assembly 116 may transition the gate 120 between an opened position, where debris in the bucket assembly 104 may transition out of the bucket assembly 104 onto an underlying surface, and a closed position, where debris is substantially restricted from passing between the gate 120 and bucket assembly 104 onto the underlying surface.

The frame assembly 102 may be pivotally coupled to a roller assembly 122 at a rear end 124. More specifically, the roller assembly 122 may be one or more wheels coupled to a swingarm 126 that is pivotable about a swingarm axis 128 defined through the first and second frame arms 110, 108. Further, a swingarm actuator 130 may be pivotally coupled between each of the first and second frame arm 110, 108 and the swingarm 126. In this configuration, the swingarm actuators 130 articulate to pivot the roller assembly 122 about the swingarm axis 128, thereby altering the height of the frame assembly 102 relative to the underlying surface.

The scraper assembly 100 may form a cavity 140 in which debris may be stored. The cavity 140 may be defined by the bucket assembly 104 at the rear end 124 and the gate 120 towards a front end 142. Further, a first removable sidewall 138 or first wiper wall is shown partially overlapping a portion of a first bucket sidewall 136 along the first frame arm 110 and a second removable sidewall 132 or second wiper wall may partially overlap a portion of a second bucket sidewall 134 at the second frame arm 108 to form opposing sides of the cavity 140. In other words, the scraper assembly 100 may contain debris within the cavity 140 between the sidewalls 138, 136, 132, 134, the bucket assembly 104, and the gate 120.

Figure 2:
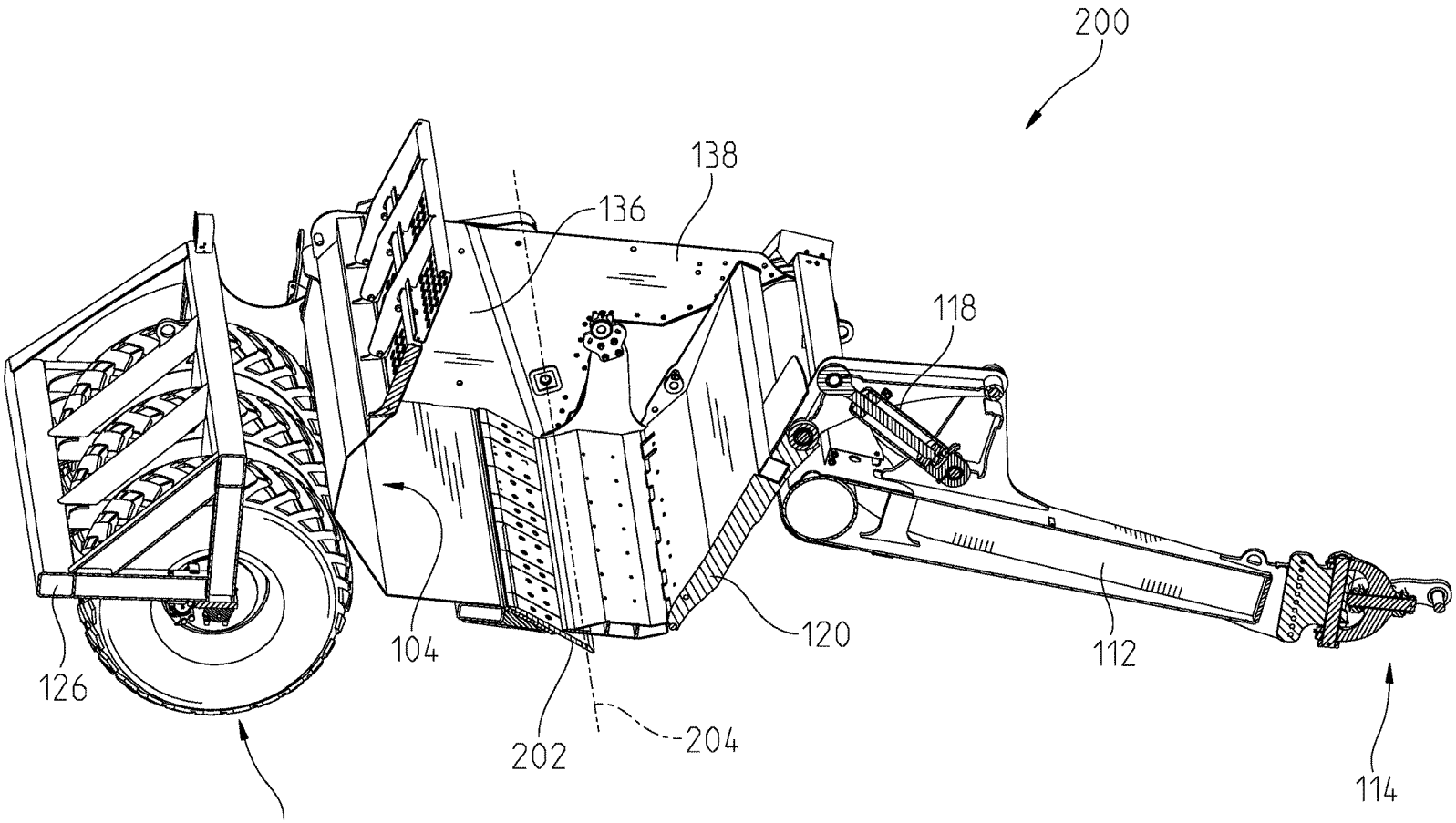
FIG. 2 is a sectional view of the scraper assembly of FIG. 1.

Referring now to FIG. 2, a section view 200 of the scraper assembly 100 is shown. More particularly, a blade 202 is illustrated along an underside of the bucket assembly 104. The blade 202 may be repositioned relative to the underlying surface by articulating the swingarm actuator 130 as described above. More particularly, the swingarm actuator 130 may extend, rotating the swingarm 126 about the swingarm axis 128 away from the frame assembly 102, thereby lowering the blade 202 relative to the underlying surface. When the blade 202 is lowered sufficiently, it may contact the underlying surface and allow debris from the underlying surface to enter the cavity 140 of the bucket assembly 104.

The scraper 100 is in a carry configuration in FIGS. 1 and 2. Further, the scraper 100 may articulate between a dump configuration and the carry configuration. In the carry configuration, the gate 120 may be down and the bucket assembly 104 may be in a carry position. In the carry configuration, debris is either maintained in the cavity 140 or added into the cavity 140 during a scraping process. At any rate, in the carry configuration, debris is substantially restricted from exiting the cavity 140 from between the gate 120 and the blade 202.

Figure 3:
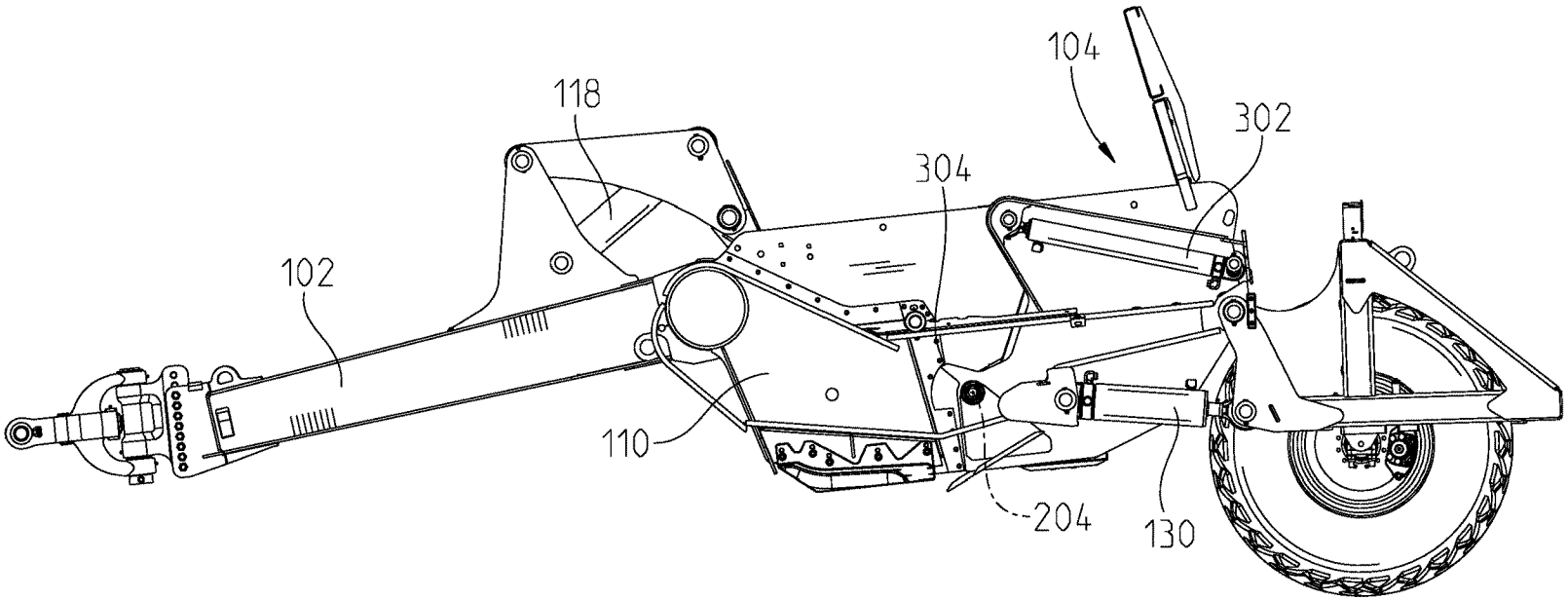
FIG. 3 is a partial side view of the scraper assembly of FIG. 1.

The scraper 100 may transition to the dump position (not particularly shown) by rotating the bucket assembly 104 about a bucket pivot or axis 204. More specifically, referring now to FIG. 3, the scraper assembly 100 is shown with a portion of the first frame arm 110 removed. In FIG. 3, a bucket actuator 302 is coupled to the first frame arm 110 of the frame assembly 102 on one end and to the bucket assembly 104 on the other end. In this configuration, the bucket actuator 302 may selectively pivot the bucket assembly 104 relative to the frame assembly 102 about the bucket axis 204. Accordingly, in one embodiment, the scraper 100 may transition from the carry configuration to the dump configuration by lifting the gate 120 with the gate actuator 118 and pivoting the bucket assembly 104 towards the gate 120 with the bucket actuator 302.

Figure 4A:
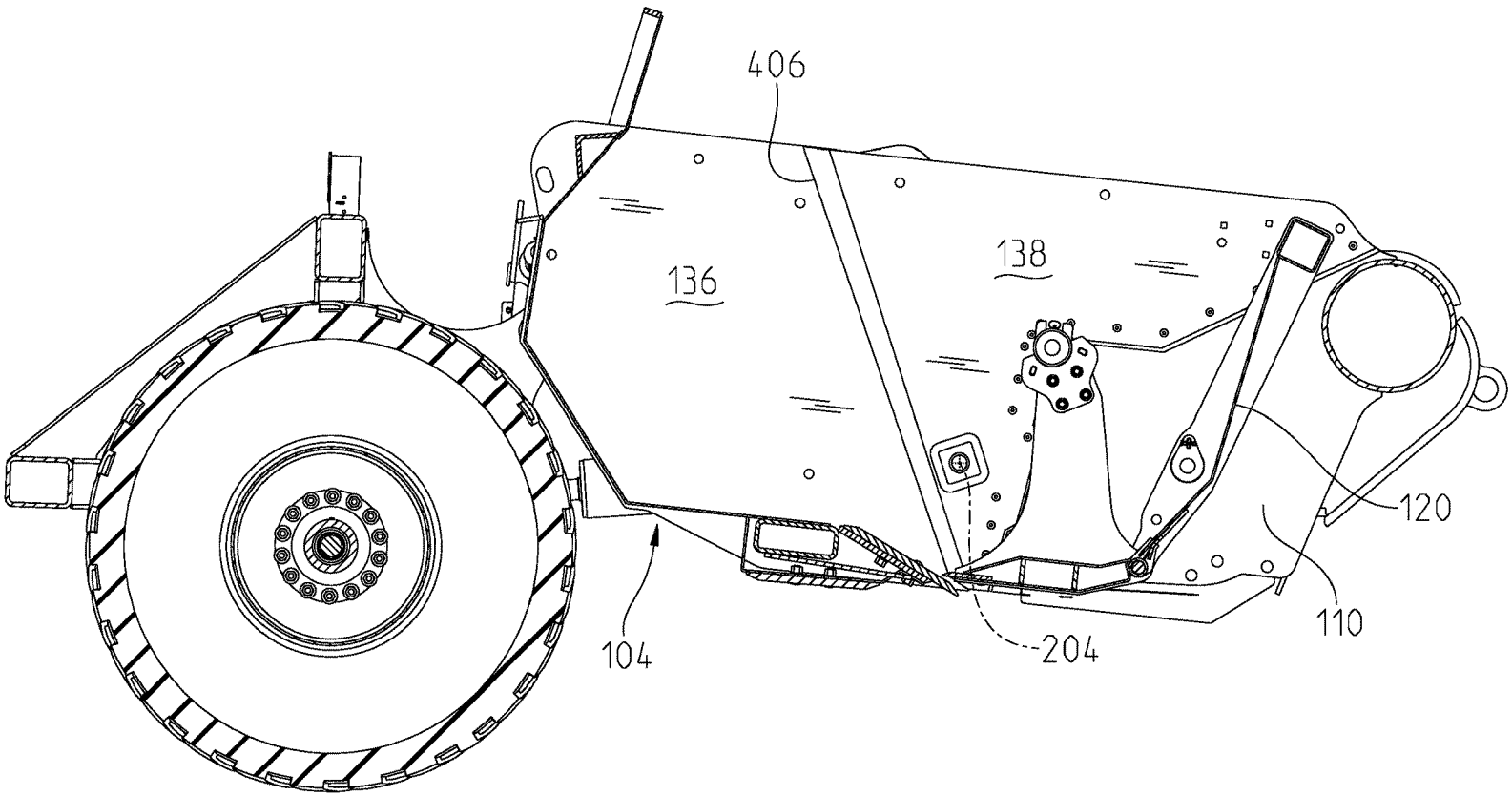
FIG. 4*a* is a sectional view of the scraper assembly of FIG. 1 in a carry configuration.
Figure 4B:
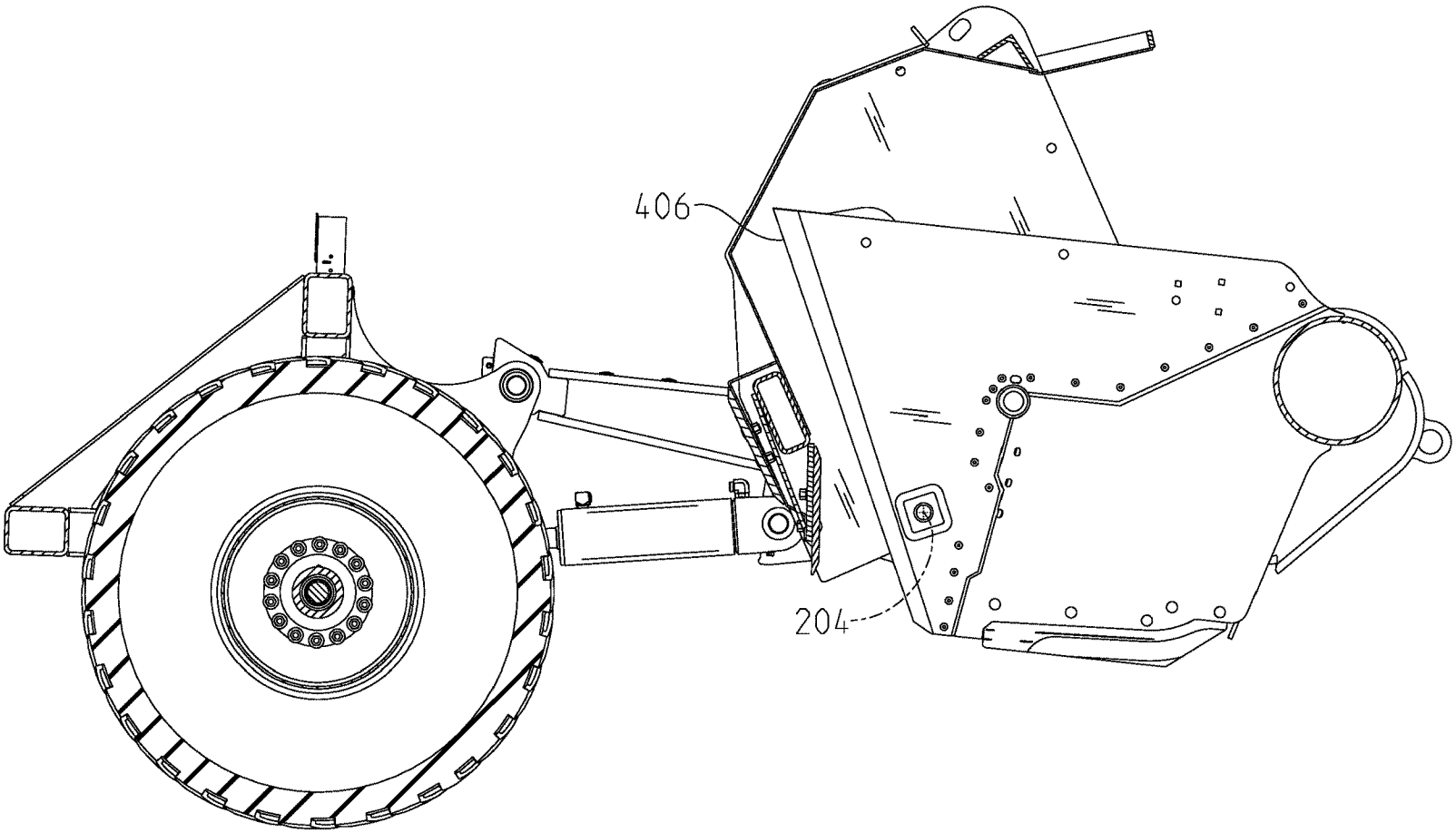
FIG. 4*b* is a sectional view of the scraper assembly of FIG. 1 in a dump configuration.

Now referring to FIGS. 4*a* and 4*b*, a partial view of the first frame arm 110 and bucket assembly 104 is shown. In FIG. 4*a*, the scraper assembly 100 is in a carry configuration. In the carry configuration, the first removable sidewall 138 is shown partially overlapping a portion of the first bucket sidewall 136. In the carry position of FIG. 4*a*, the first removable sidewall 138 and the first bucket sidewall 136 together form a barrier along the side of the scraper assembly 100 to substantially restrict debris from passing therethrough.

Although not specifically shown in FIGS. 4*a* and 4*b*, the second removable sidewall 132 may also partially overlap a portion of the second bucket sidewall 134 at the second frame arm 108. Similarly as described above for the first removable sidewall 138 and the first bucket sidewall 136, the second removable sidewall 132 and the second bucket sidewall 134 together form a barrier along the side of the scraper assembly 100 to substantially restrict debris from passing therethrough. In other words, in the carry configuration, the corresponding removable and bucket sidewalls 138, 136, 132, 134 define the ends of the cavity 140 along the first and second frame arms 110, 108.

The relationship between the first removable sidewall 138 and the first bucket sidewall 136 is described in more detail below. However, the following description for the first removable sidewall 138 and the first bucket sidewall 136 apply similarly to the second removable sidewall 132 and the second bucket sidewall 134. More specifically, the second removable sidewall 132 and the second bucket sidewall 134 may be substantially mirrored components of the first removable sidewall 138 and the first bucket sidewall 136. Accordingly, while this disclosure discusses the relationship of the first removable sidewall 138 and the first bucket sidewall 136 in detail below, the description applies equally to the relationship of the second removable sidewall 132 and the second bucket sidewall 134.

The first removable sidewall 138 may have a leading edge 406 that is meant to contact, or otherwise come into close proximity with, the surface of the first bucket sidewall 136. In one nonexclusive example, when the scraper assembly 100 transitions from the carry position of FIG. 4*a* to the dump position of FIG. 4*b*, the leading edge 406 scrapes debris from the surface of the corresponding bucket sidewall.

Figure 5A:
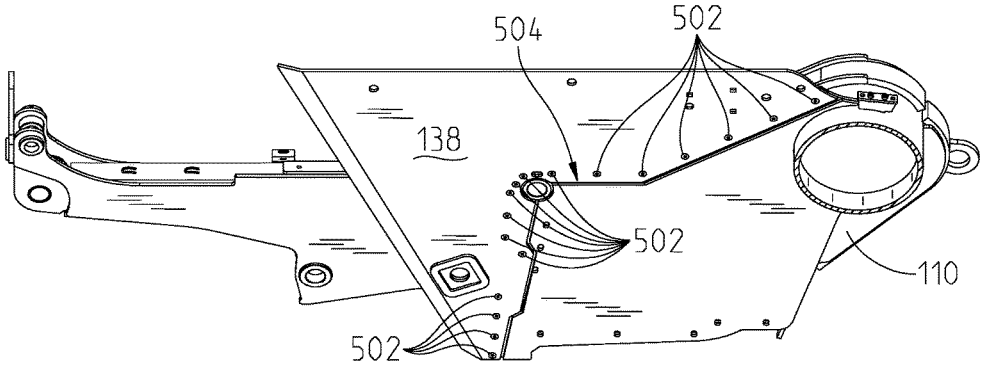
FIG. 5*a* is an isolated view of a first frame arm of the scraper assembly of FIG. 1 with a removable sidewall coupled thereto.
Figure 5B:
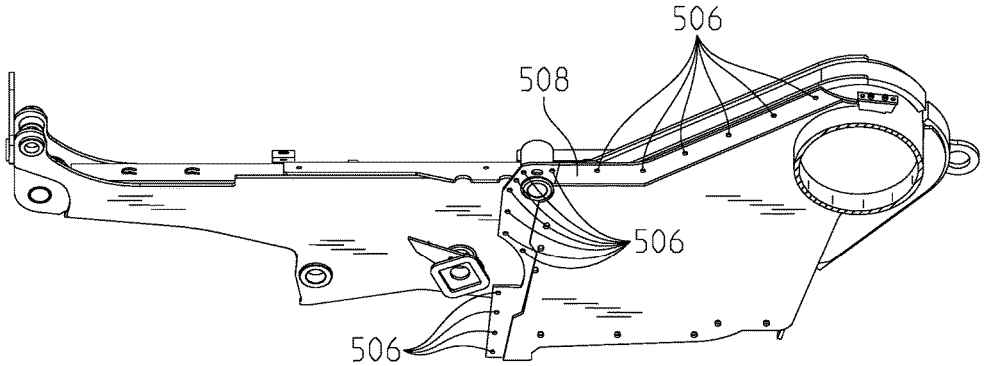
FIG. 5*b* is an isolated view of a first frame arm of the scraper assembly of FIG. 1 without the removable sidewall from FIG. 5*a;*

Referring now to FIGS. 5*a* and 5*b*, the first frame arm 110 is shown isolated from the bucket assembly 104. FIG. 5*a* illustrates the first frame arm 110 with the first removable sidewall 138 coupled thereto. More specifically, FIG. 5*a* shows a plurality of sidewall through-holes 502 positioned along a sidewall profile 504. The plurality of sidewall through-holes 502 may correspond with a plurality of bracket through-holes 506. More specifically, FIG. 5*b* illustrates the first frame arm 110 with the first removable sidewall 138 removed. A bracket 508 is shown positioned along the sidewall profile 504 and coupled to the first frame arm 110. The first removable sidewall 138 may be selectively coupled to the bracket 508 when the plurality of sidewall through-holes 502 is aligned with the plurality of bracket through-holes 506. Further, fasteners may be utilized through the aligned through-holes 502, 506 to removably couple the first removable sidewall 138 to the first frame arm 110.

In one embodiment, the plurality of sidewall through-holes 502 may be inwardly tapered to correspond with the fasteners. In other words, when the fasteners couple the first removable sidewall 138 to the bracket 508, the heads of the fasteners may be substantially coplanar with a surface of the first removable sidewall 138.

One embodiment of the present disclosure utilizes threaded fasteners with tapered heads on one side coupled to a threaded nut on the other. The tapered head may be positioned along any one of the plurality of sidewall through-holes 502 and the threaded nut may be positioned at an opposite side of the bracket 508 relative to the tapered head. In this embodiment, threaded fasteners may be positioned through each of the corresponding through-holes 502, 506 and the first removable sidewall 138 may be coupled to the bracket 508 by applying a torque to the fasteners.

While threaded fasteners are described above, in one embodiment the first removable sidewall 138 may be coupled to the bracket 508 via stitch welds. In this embodiment, the plurality of sidewall through-holes 502 may be one or more slots defined therethrough. Further, the bracket 508 may have extruded sections along a surface of the bracket 508 that correspond with the slots in the sidewall 138. When the sidewall 138 is properly aligned with the bracket 508, the extruded sections of the bracket 508 may be at least partially positioned within the slots of the sidewall 138. Then, the sidewall 138 may be stitch-welded to the bracket 508 or the first frame arm 110. The stitch welding may be intermittent beads positioned along the sidewall profile that can be accessed and removed from within the cavity 140 of the scraper assembly 100 to allow easy removal of the sidewall 138. Further, in one embodiment a spot weld may be positioned at each of the slots to couple the sidewall 138 to the bracket 508.

Figure 6A:
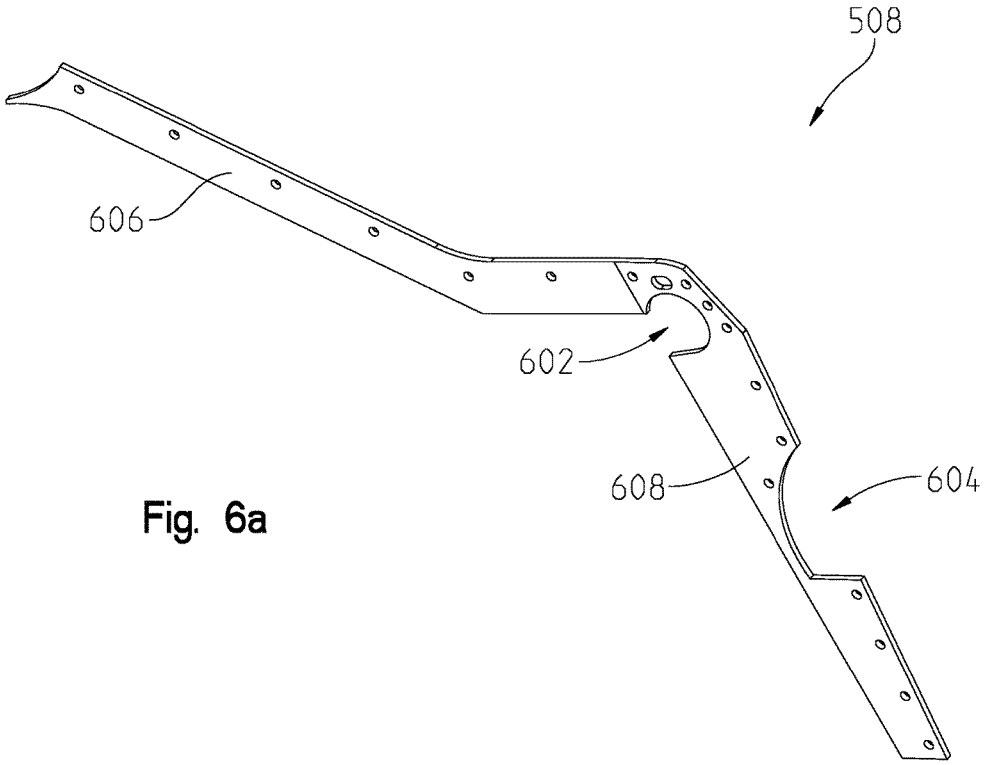
FIG. 6*a* is an isolated perspective view of a bracket from the scraper assembly of FIG. 1.
Figure 6B:
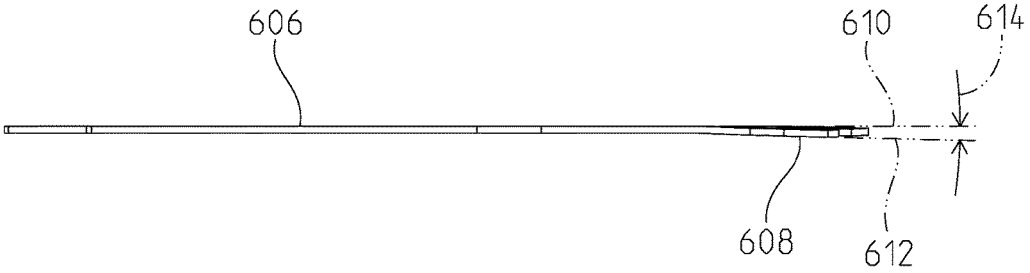
FIG. 6*b* is a top view of the bracket from FIG. 6*a;*
Figure 7A:
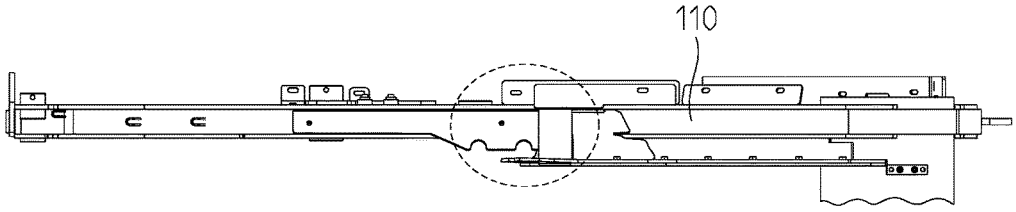
FIG. 7*a* is a top view of the first frame arm of the scraper assembled of FIG. 1.
Figure 7B:
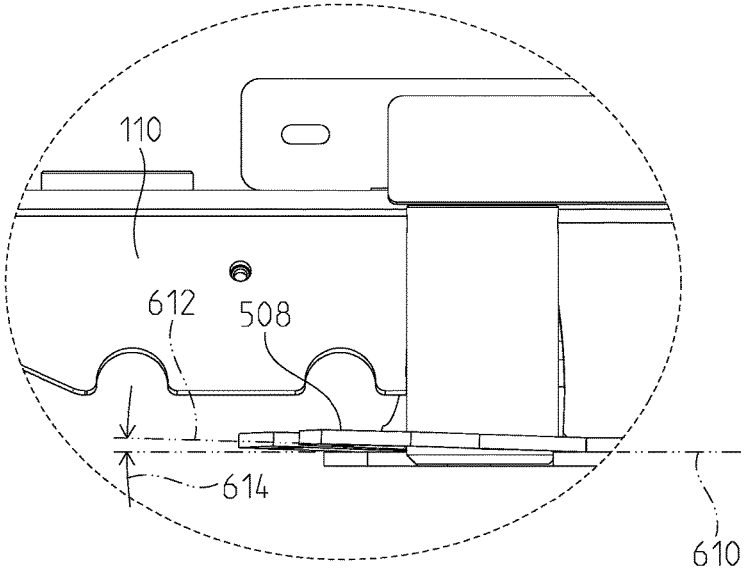
FIG. 7*b* is a detailed top view of FIG. 7*a;*

Referring now to FIGS. 6*a* and 6*b* (see also FIGS. 7*a* and 7*b*); the bracket 508 is shown isolated from the first frame arm 110. In addition to defining a plurality of bracket through-holes 506, the bracket 508 may have a gate pivot cutout 602 defined therethrough. The gate pivot cutout 602 may correspond with a gate pivot mount (not particularly shown) coupled to each of the first and second frame arm 110, 108. The gate pivot cutout 602 may allow the bracket 508 to become coupled to the corresponding first and second frame arms 110, 108 without interfering with the pivotal movement of the gate 120.

The bracket 508 may also have a bucket pivot cutout 604 defined therethrough. The bucket pivot cutout 604 may be positioned proximate to the bucket axis 204 when coupled to the frame arm 110, 108. Further, the bucket pivot cutout 604 may have a profile that corresponds with a bucket finger 304 (FIG. 3). The bucket pivot cutout 604 may allow the bucket finger 304 to transition between the carry orientation of FIG. 4*a* and the dump configuration of FIG. 4*b* without substantially contacting the bracket 508. In another embodiment, the bucket pivot cutout 604 may contact the bucket finger 304 when the bucket assembly 104 is in the dump configuration.

The bracket 508 may have a top portion 606 and a side portion 608 coupled to one another. In one embodiment, the top portion 606 and the side portion 608 are integrally formed from the same material. In a different embodiment, the top portion 606 may be welded or otherwise coupled to the side portion 608. However, as shown in FIG. 6*b*, in one non-exclusive embodiment the top portion 606 and the side portion 608 are not coplanar. In other words, the top portion 606 may be defined along a plane that is substantially parallel with the outer surface of the first bucket sidewall 136 but the side portion 608 may be defined along a plane that is biased towards the outer surface of the corresponding bucket sidewall 136.

FIG. 6*b* further illustrates the planar relationship between the top portion 606 and the side portion 608. As shown in FIG. 6*b*, the top portion 606 is defined along a top portion plane 610 and the side portion is defined along a side portion plane 612. The side portion plane 612 may be angularly offset from the top portion plane 610 by an angle 614. In one embodiment, the angle 614 is between 1 and 3 degrees. In another embodiment, the angle is 2 degrees. However, no particular angle 614 is limiting, and this disclosure considers many different angles.

Offsetting the angle 614 of the top portion plane 610 relative to the side portion plane 612 may allow the removable sidewall 138 to become biased towards the corresponding bucket sidewall 136 when the removable sidewall 138 is coupled to the bracket 508. More specifically, if the removable sidewall 138 is coupled to the bracket 508 utilizing the threaded fasteners described above, the removable sidewall 138 may become biased towards the bucket sidewall 136 as it is threadably coupled to the bracket 508. In other words, the portion of the sidewall 136 coupled to the top portion 606 of the bracket 508 may remain in the top portion plane 610 but the portion of the sidewall 136 coupled to the side portion 608 of the bracket 508 may become biased towards the side portion plane 612.

In one embodiment, the removable sidewall 138 may be defined as having a substantially coplanar body (except for the leading edge 406) when the removable sidewall 138 is not coupled to the bracket 508. However, when the removable sidewall 138 is coupled to the bracket 508, the sidewall 138 may at least partially deform, thereby no longer having a substantially coplanar body. The deformation of the sidewall 138 may bring the leading edge 406 closer to the corresponding bucket sidewall 136, thereby more efficiently scraping debris as the scraper assembly 100 transitions between the carry configuration and the dump configuration.

Deforming the removable sidewall 138 when it is fastened to the bracket 508 may also simplify manufacturing of the removable sidewall 138. As described above, the removable sidewall 138 may be more effective at removing debris if it is tapered towards the corresponding bucket sidewall 136. The above disclosure teaches a method and apparatus that allows the removable sidewall 138 to be deformed during installation instead of when the sidewall is manufactured.

One aspect of the present disclosure is a method for manufacturing the scraper assembly 100. The method includes pivotally coupling the frame assembly 102 to the bucket assembly 104 at the bucket axis 204. Further, the brackets 508 may be coupled to the corresponding frame arms 110, 108. The brackets 508 may be coupled to the corresponding frame arms 110, 108 utilizing any coupling method known in the art. More specifically, in one embodiment the brackets 508 may be welded to the frame arms 110, 108. However, in another embodiment the brackets 508 may be integrally formed with the corresponding frame arms 110, 108. Further, the brackets 508 may be positioned to avoid interference with the corresponding sidewalls 136, 134 of the bucket assembly 104 when the scraper 100 is in both the dump configuration and the carry configuration.

The removable sidewalls 138, 132 may be coupled to the corresponding frame arms 110, 108 through the brackets 508 with the one or more fasteners. As described above, the method includes deforming an outer surface of the removable sidewalls 138, 132 out of planar alignment when coupling the removable sidewalls 138, 132 to the corresponding frame arms 110, 108 with at least one of the fasteners. Further still, in one embodiment of the present disclosure the removable sidewalls 138, 132 will deform sufficiently to contact the corresponding sidewalls 136, 134 when coupled to the brackets 508.

Similarly, the removable sidewalls 138, 132 may be removed from the corresponding frame arms 110, 108 by uncoupling the fasteners from the brackets 508. In other words, the removable sidewalls 138, 132 may be removed without using a cutting tool such as a grinder, saw, torch, or other similar cutting device.

While this disclosure has been described with respect to at least one embodiment, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A scraper system, comprising:

a frame assembly having a frame arm;

a bucket assembly having a first sidewall;

a second sidewall removably coupled to the frame arm; and a bracket coupled to the frame arm and selectively coupled to the second sidewall, the bracket comprising a first portion and a second portion coupled to one another;

wherein, the first portion is angularly offset from the second portion;

wherein, the bucket assembly is pivotally coupled to the frame arm and the second sidewall is positioned adjacent to the first sidewall.

2. The scraper system of claim 1, further wherein the second sidewall is coupled to the frame arm with threaded fasteners.

3. The scraper system of claim 1, further wherein the second sidewall is removable from the frame arm without using a cutting tool.

4. The scraper system of claim 1, further wherein the bracket defines a coupling surface that is not planar.

5. The scraper system of claim 4, further wherein the second sidewall is coupled to the corresponding bracket along the coupling surface.

6. The scraper system of claim 1, wherein the first sidewall is coupled to the bracket.

7. The scraper system of claim 6, wherein a first sidewall portion of the first sidewall is coupled to the first portion of the bracket, and a second sidewall portion of the first sidewall is coupled to the second portion of the bracket.

8. The scraper system of claim 7, wherein the first sidewall portion of the first sidewall is angularly offset relative to the second sidewall portion.

9. The scraper system of claim 1, wherein the second sidewall comprises a deformable body, the deformable body being substantially coplanar when it is not coupled to the bracket and the deformable body being non-coplanar when the second sidewall is coupled to the bracket.

10. The scraper system of claim 1, wherein the second sidewall comprises a leading edge located in contact with or in close proximity to the first sidewall when the second sidewall is coupled to the bracket.

11. The scraper system of claim 1, wherein the first portion and second portion are angularly offset from one another by at least 1-3°.

12. The scraper system of claim 1, wherein the first portion is integrally formed with the second portion.

13. The scraper system of claim 1, wherein the first portion is welded to the second portion.

14. The scraper system of claim 1, wherein the bracket defines a first cutout portion defined between the first portion and second portion thereof.

15. The scraper system of claim 14, wherein the bracket defines a second cutout portion defined in the second portion of the bracket.

16. The scraper system of claim 15, wherein the bucket assembly comprises a bucket pivot about which the bucket assembly pivots between a carry position and a dump position, the bucket pivot being located in the second cutout portion.

17. The scraper system of claim 16, wherein the bucket assembly comprises a bucket finger, the bucket finger being movable between the carry position and dump position without contacting the bracket.

18. The scraper system of claim 16, wherein the bucket assembly comprises a bucket finger, the bucket finger being movable between the carry position and dump position without contacting the bracket until the bucket assembly is in the dump position.

* * * * *